United States Patent [19]

Bryan

[11] 4,296,727

[45] Oct. 27, 1981

[54] FURNACE MONITORING SYSTEM

[75] Inventor: Edward L. Bryan, Dallas, Tex.

[73] Assignee: Micro-Burner Systems Corporation, Addison, Tex.

[21] Appl. No.: 136,719

[22] Filed: Apr. 2, 1980

[51] Int. Cl.[3] ..... F24H 3/00; G01L 3/26; F23N 1/00

[52] U.S. Cl. ..... 126/116 A; 73/112; 165/11 R; 165/33; 236/15 BR; 431/76

[58] Field of Search ..... 126/116 A; 165/11, 33; 236/15 BR; 237/2 A; 110/190, 101 C, 101 CF, 101 CA; 431/18, 37, 66, 67, 76, 89

[56] References Cited

U.S. PATENT DOCUMENTS

| | | | |
|---|---|---|---|
| 1,605,779 | 0/1926 | Rissman . | |
| 1,686,186 | 0/1928 | Spitzglass . | |
| 1,730,541 | 0/1929 | Spitzglass . | |
| 2,040,086 | 0/1936 | Goodwillie . | |
| 2,210,082 | 0/1940 | Johnson . | |
| 2,252,367 | 0/1941 | Germer . | |
| 2,252,369 | 0/1941 | Germer . | |
| 2,283,745 | 0/1942 | Lines . | |
| 2,293,403 | 0/1942 | Razek | 177/351 |
| 2,305,769 | 0/1942 | Germer | 73/193 |
| 2,341,407 | 0/1944 | Xenis et al. | 234/5.8 |
| 2,342,567 | 0/1944 | Xenis et al. | 73/51 |
| 2,357,921 | 0/1944 | Xenis et al. | 73/51 |
| 2,593,659 | 0/1952 | Dickey | 73/112 |
| 2,596,030 | 0/1952 | Junkins | 73/112 |
| 2,723,558 | 0/1955 | Germer | 73/112 |
| 2,723,559 | 0/1955 | Germer | 73/112 |
| 2,793,813 | 5/1957 | Belcher | 236/15 BR |
| 3,017,112 | 1/1962 | Amundson | 126/116 A |
| 3,058,663 | 10/1962 | Barnard | 165/33 |
| 3,216,661 | 11/1965 | Sawyer | 431/76 |
| 3,236,449 | 0/1966 | Brunner | 236/15 |
| 3,284,615 | 0/1966 | Yetter | 235/150.1 |
| 3,300,965 | 1/1967 | Sherlaw et al. | 165/33 |
| 3,743,009 | 7/1973 | Dagerford | 165/11 |
| 3,985,294 | 10/1976 | Guido | 236/15 BR |
| 3,999,933 | 12/1976 | Murphy | 431/18 |
| 4,033,712 | 0/1977 | Morton | 431/90 |
| 4,043,743 | 0/1977 | Seider | 431/76 |
| 4,165,630 | 0/1979 | Felder | 73/23 |
| 4,186,295 | 1/1980 | Iwao | 236/15 BR |
| 4,200,910 | 4/1980 | Hall | 165/11 |
| 4,227,645 | 10/1980 | Lafarge et al. | 165/11 |

*Primary Examiner*—Daniel J. O'Connor

*Attorney, Agent, or Firm*—Roylance, Abrams, Berdo & Farley

[57] ABSTRACT

A system for monitoring the operation of a heating apparatus having a combustion chamber with associated air and fuel supplies and an exhaust path includes sensors for monitoring temperatures at the combustion chamber. A microprocessor and a display receives signals from these sensors and has a keypad to permit calculation and display of parameters indicative of proper operation of the heating system including fuel usage per unit time. Limit values can be stored in the processor memory to trigger alarms when temperatures or fuel usage exceed the set limits. Various measured and calculated values can be displayed.

8 Claims, 9 Drawing Figures

FURNACE MONITORING SYSTEM

This invention relates to an apparatus for monitoring and displaying operating parameters of a heating or industrial system of the furnace or boiler type used in the home, commercial or moderate size industrial establishments.

BACKGROUND OF THE INVENTION

In recent years it has become readily apparent that there is a finite quanitity of fossil fuel available for future use and that the cost of such fuel is increasing and will continue to increase for the forseeable future. While alternative energy sources are and will probably continue to be developed, substitutes for fossil fuel cannot be relied upon as a total or even significant, alternative in the near future. Thus, it has become extremely important to improve the efficiency of existing and newly installed heating and process systems which employ fossil fuel.

Large commercial installations of an industrial type are sometimes instrumented and provided with complex control systems which permit operating characteristics of those systems to be observed and optimized. However, there are thousands of furnace and boiler systems in the United States and other countries in private homes, multiple family dwellings and commercial establishments which use a significant quanitity of fuel and which have substantially no equipment to permit efficiency evaluation. While great attention has been paid to more efficient use of the systems on a time basis through more sophisticated thermostatic control of the spaces being heated, and while considerable attention has been paid to more effective insulation and the like, there remains no dynamic real-time technique for evaluating the efficient use of the fuel in the combustion process itself. Furthermore, existing systems of an industrial type are not readily adaptable to smaller furnace or boiler use and are, generally, far too expensive to be economically justifiable, even in the face of increasing fuel costs.

BRIEF SUMMARY OF THE INVENTION

Accordingly, it is an object of the present invention to provide an apparatus for monitoring operating parameters of a heating system of the furnace or boiler type and, particularly, to provide information about the operating efficiency of such systems.

A further object is to provide an apparatus which is capable of sensing and providing displays of predetermined characteristics of the system and to calculate and display information about fuel usage and operating temperatures to permit the system user to adjust the furnace when the system efficiency is undesirably low or shows a decreasing trend.

A further object is to provide a system of the type described in which limit or threshold values can be predetermined and entered into the system and which will provide alarm indications when the threshold values are exceeded, either in an upward or downward direction.

Briefly described, the invention includes a monitoring and display apparatus for use in combination with a system of the type having a combustion chamber, adjustable means for supplying air to the combustion chamber to support combustion, and exhaust duct for exhausting combustion products from the combustion chamber, a fuel input nozzle and conduit means connectable therefrom to a fuel source for supplying fuel to the combustion chamber, and a heat exchanger in the gas flow path between the combustion chamber and the exhaust duct for heating a fluid medium, the apparatus comprising first and second transducer means for sensing the temperatures at the combustion chamber and the exhaust duct, respectively, and for producing electrical signals representative of said temperatures, third transducer means coupled to said conduit means for sensing the rate of flow of fuel to said fuel input nozzle, fourth transducer means coupled to the exhaust duct for producing a signal representative of the level of unoxidized carbon in the combustion products flowing through said duct, and logic and display means electrically connected to said transducer means for calculating and selectively displaying parameters representive of the operation of said heating system comprising a clock, memory means for storing digital data representative of the temperature, flow rate and unoxidized carbon parameters sensed by said transducers and of preselected limit values for selected ones of said parameters, input means including a keyboard for manually supplying said preselected limit values to said memory means, calculator means responsive to said clock and to the sensed parameters stored in said memory means for calculating fuel usage per unit time and for supplying a signal representative thereof to said memory means, and alarm means for periodically comparing said limit values with the sensed parameters and for providing a perceivable indication when said limit values are exceeded.

Also disclosed is an apparatus of the type described and including fifth tranducer means for sensing the temperature at the heat exchanger and for producing electrical signals representative of said temperature.

In order that the manner in which the foregoing and other objects are obtained in accordance with the invention can be understood in detail, particularly advantageous embodiments thereof will be described with reference to the accompanying drawings, which form a part of this specification and wherein.

Figure 1:
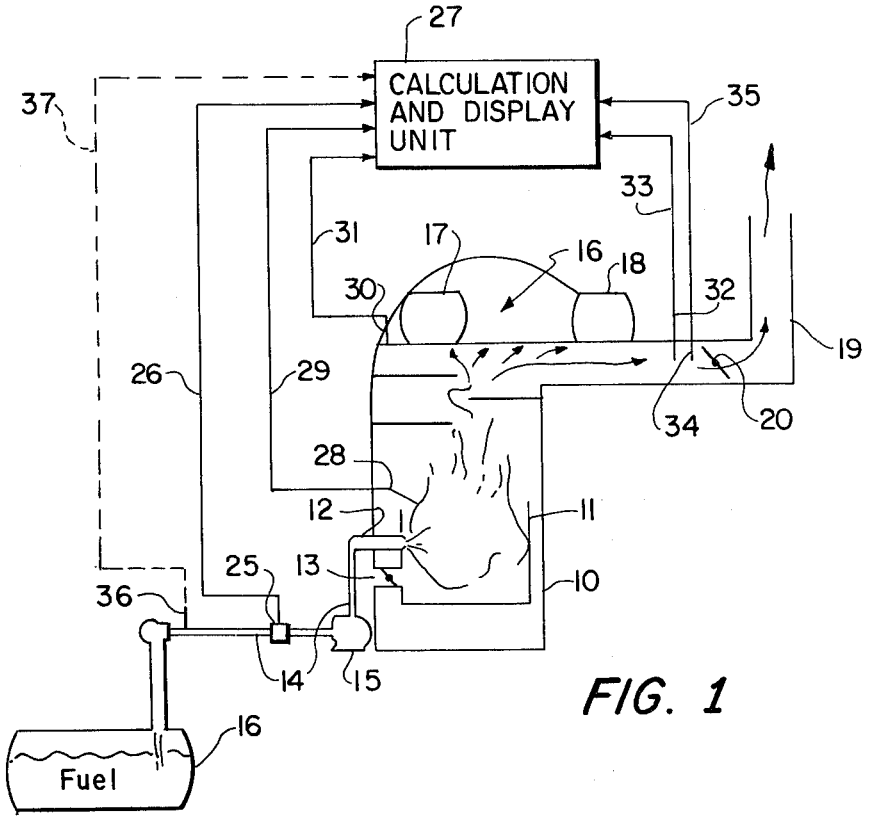
FIG. 1 is a schematic side elevation of a furnace equiped with an apparatus in accordance with the present invention.

Turning now to the drawings in detail, FIG. 1 illustrates, in a somewhat simplified form, a typical furnace or boiler having a housing 10 and a combustion chamber 11. Fuel is introduced into the combustion chamber through a nozzle 12 and is ignited by conventional means, producing a flame to heat air. The combustion air is introduced through a port 13 which is illustrated as having an adjustable opening and which may actually be ported directly to the nozzle for atomization and draft. Commonly, the opening consists of a rotatable plate having an opening therein which is adjustably alignable with an opening through the side of the furnace or nozzle gun assembly, the rotatable plate being adjustable to alter the degree of alignment of the two openings, thereby controlling the amount of air which can flow therethrough. The particular nature of the adjustable opening is not critical and does not form a part of the present invention.

Fuel is supplied through a conduit 14 to nozzle 12. The fuel can be either oil or gas and the supply system can include a pump or regulator 15 and, particularly in the case of oil, a supply tank 16. Again, the supply system itself, being conventional, does not form a part of the present invention.

The combustion products from the combustion chamber flow through a heat exchanger region indicated generally at 16 wherein the exhaust gases contact heat exchange surfaces to supply heat to a fluid medium, typically air or water, flowing through inlet and outlet passages 17 and 18, after which the exhaust gases pass through an exhaust duct 19. A damper 20 which can be automatically or manually adjustable, is commonly supplied in the exhaust duct, after which the gases pass through a stack or chimney, not illustrated.

As will be recognized, the furnace illustrated in FIG. 1 is no more than a generalized, simplified illustration of a typical furnace or boiler arrangement, and that there are many such arrangements in use and possible. The specific arrangement is not particularly important to the present invention because the components described will all exist, in one form or another, in a furnace and the apparatus of the present invention is usable with substantially any arrangement.

The instrumentation associated with the furnace in accordance with the present invention includes a flow detecting transducer 25 having an electrical output signal provided on a conductor 26 to supply a signal to a calculation and display unit 27 which will be further described. A temperature measuring transducer 28 is installed in the furnace so that the active end thereof is in the combustion chamber such that transducer 28 can sense the temperature in the combustion chamber, determining the existence of a flame and the temperature thereof. The signal from transducer 28 is supplied on conductor 29 to unit 27. Preferably, transducer 28 is a chromel-alumel high temperature thermocouple. A similar thermocouple transducer 30 is attached in good heat exchange relationship with a surface of the heat exchanger, the signal therefrom being conducted on a conductor 31 to unit 27. A third transducer 32 is provided in the exhaust duct to measure the exhaust temperature, transducers 30 and 32 also being chromel-alumel thermocouples. The signal from transducer 32 is provided on a conductor 33 to unit 27. The remaining transducer 34 is a carbon and soot detector to measure and monitor unoxidized carbon present in the flue gases constituting the combustion products passing through duct 19, and the output of transducer 34 is supplied on a conductor 35 to unit 27.

The following symbols will be used herein to refer to system parameters:

TN: Temperature at the fuel input nozzle in the combustion chamber as sensed by thermocouple 28.

TE: Temperature at the heat exchanger as sensed by thermocouple 30.

TS: Temperature in the stack or exhaust duct as sensed by thermocouple 32.

C: Quantity of carbon particles as measured by transducer 34.

FF: Flow rate of fuel (tenths of gallons per hour or MCF/HR).

In addition to the above, a further thermocouple 36 can be added in the fuel line to provide a signal on a conductor 37 representative of the temperature of the fuel if that fuel is natural gas. With that temperature, TG, and the flow rate FF, the amount of fuel can be calculated, using well-known gas law equations.

Figure 2:
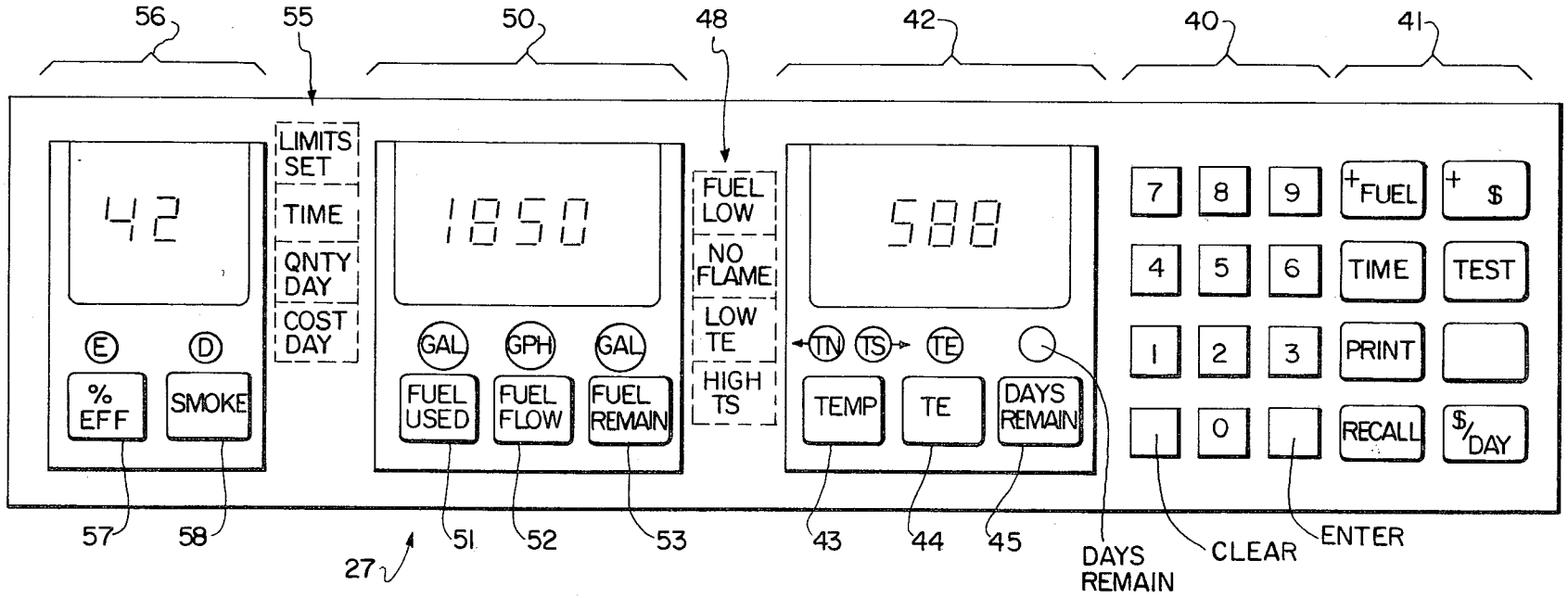
FIG. 2 is a front elevation showing the arrangement of system input and control devices and display modules in an apparatus in accordance with the invention.

FIG. 2 shows the front panel of the calculation and display unit 27 with the various display modules, key boards and indicator lights. At one end of the panel, to the right as seen in FIG. 2, it a 12-key numeric keyboard indicated generally at 40 which has 10 number keys, a "clear" key and an "enter" key for inserting various values, including limit values. Adjacent and to the right of that keyboard is an eight-key board 41 with function keys, seven of which are labeled to perform desired functions. The eighth key is, in the embodiment shown, not used.

To the left of the numeric keyboard is a display panel 42 for selectively displaying the temperatures TS or TE or the days remaining in the fuel supply on a screen 46, each display being produced in response to depression of one of the appropriately labeled control buttons or keys 43, 44 or 45 below the display. The display screen 46 itself is a conventional light emitting diode or liquid crystal display (LED or LCD) of the seven-segment digital type.

To the left of panel 42 is a vertically arranged cluster of indicator lights indicated generally at 48 for indicating alarm conditions such as fuel low, no flame, low TE or high TS. The conditions are displayed when the respective values reach or pass limit values pre-established for these conditions and stored in the memory.

To the left of indicators 48 is a display panel 50 for displaying values of fuel used, fuel flow (in e.g., tenths of gallons per hour) and fuel remaining. This panel also displays the temperature TN when button 43 in panel 42 is depressed. Again, the screen for exhibiting these values is an LED or LCD unit and the value desired is displayed in response to depression of an appropriately labled one of keys 51, 52, and 53 below the screen.

To the left of panel 50 is another vertically arranged cluster of mode indicator lights 55 for indicating the "limit set" function, the time, fuel quantity used per day, and cost per day.

To the left of indicators 55 is a third display panel 56 for selectively displaying percent thermal efficiency and a figure representing the smoke density in the stack, either as a percentage or as a number on an arbitrary scale of, e.g., one to ten, in response to depressing on of keys 57 and 58 below the screen. The display screen is, again, an LED or LCD digital display.

In addition to the quantities mentioned, the time is displayed in response to depression of the time key in keyboard 41 with the hours being displayed on panel 56, minutes on panel 50 and seconds on panel 42.

In addition to the keys mentioned, an annunciator light is provided above each of the function keys on the display panel, indicating which figures are being displayed at any given time. These are indicated by the letters of groups of letters in circles above buttons 51–53, 57, 58 and 42–45. In actuality, these annunciator indications would normally be letters illuminated from behind by small light emitting diodes mounted behind the panel.

Figure 3:
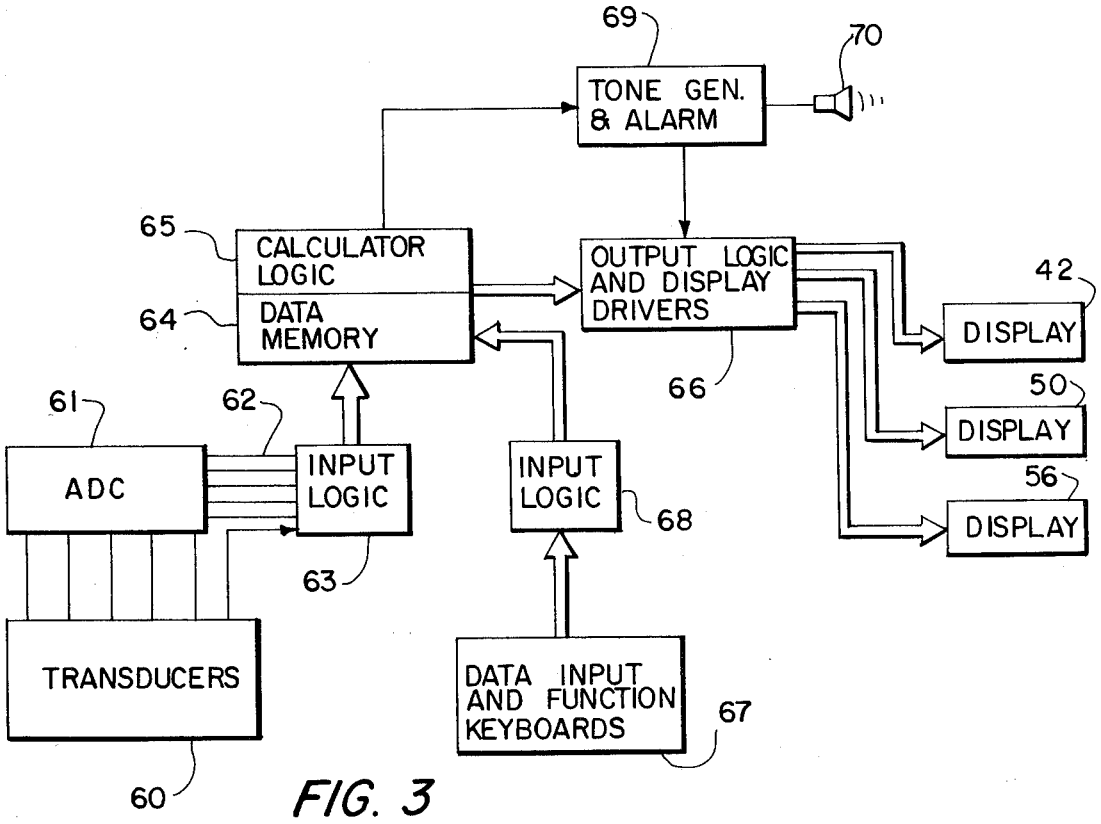
FIG. 3 is a functional schematic block diagram of an apparatus in accordance with the invention.

The foregoing general description of the panel arrangement will facilitate an understanding of the functions and procedures involved in the operation and use of the equipment. A functional block diagram of the apparatus itself is shown in FIG. 3 in which, the various transducers, discussed in connection with FIG. 1, are illustrated as a block of transducers 60, the outputs of which, except for the fuel flow transducer, are supplied to an analog to digital converter 61 in the calculation and display unit 27. The fuel flow transducer is excepted because it supplies an output which is already in digital form and need not be converted. Converter 61 receives the signals produced by the various transducers and converts them to digital form, the digital signals being supplied on conductors 62 to an input logic unit 63 which supplies the digital signals in an appropriate format, and to the appropriate sections of, a data memory 64. Calculations to be performed on, and using, the sensed values supplied to the memory are performed by a calculator logic unit 64, and data from the memory and from the calculator are supplied to output logic and display drivers 66.

Data is also supplied from the data input and function keyboards 67, discussed in connection with FIG. 2, through input logic 68 to the memory. Values which exceed predetermined threshold limits and which require the signalling of an alarm produce signals supplied to a tone generator and alarm unit 69 which can produce an alarm signal on a speaker 70 and also supply signals to appropriate annunciators through the logic and display drivers 60. Unit 66 supplies appropriate signals to provide the displays on display panels 42, 50 and 56, and also to illuminate appropriate ones of indicators 48 and 55 and the indicators associated with the keys on the display panels.

The block diagram of FIG. 3 is presented as being a functional block diagram of a system which can be assembled to perform the desired functions in accordance with the present invention. However, it will be recognized that these functions can advantageously be performed by an appropriately programmed microprocessor unit, in which case blocks would not exist, strictly speaking, in the arrangement of separate units illustrated in FIG. 3. However, the arrangement of FIG. 3 can be employed if discrete units are used for the system.

The tone generator and alarm produces audible tones as the apparatus is operated to indicate to the operator the correctness of sequences taken and the fact that further sequencing can or should be taken. Four separate codes are employed, a short tone being produced each time a key has been pressed in proper sequence indicating that the operator can proceed to the next step. A longer tone is produced when a sequence of key operations has been completed to produce a specific indication. Thus, when hearing the longer tone, the operator knows that no more keys are required to complete that sequence. A very long tone indicates that a mistake has been made and that all entries previously made in the sequence have been erased. The operator then knows that he must start over from the beginning of that sequence. Repeated groups of four tones indicate that an alarm has been triggered by a value exceeding a predetermined threshold limit. At the same time, the appropriate one or ones of indicator lights 48 on the front panel is illuminated to show the operator which alarm limit has been exceeded.

The following table identifies various keys which are used to display monitored and calculated values and briefly correlates the key identification with the purpose of that key and the display produced, and the location of the display.

TABLE 1

Display of Monitored and Calculated Values

| Key Ident. | Purpose & Display |
|---|---|
| % EFF (57) | Displays theoretical efficiency percentage on screen of display 56 while TN and TS are shown on displays 50 and 42, respectively. |
| SMOKE (58) | Smoke value, number on scale of 1 (clear) to 10 (opaque), displayed on 56; quantity of fuel used yesterday (gal.) on 50; and quantity used two days ago on 42. |
| Fuel Used (51) | Quantity in gallons or MCF since last fuel refill, shown on 50. |
| Fuel Flow (52) | Fuel flow rate, tenths of GPH or MCF/Hr. shown on 50. |
| Fuel Remain (53) | Quantity remaining in storage shown on 50. |
| TEMP (43) | TN displayed on 50, TS on 42, °F. |
| TE (44) | In °F. on 42. |
| DAYS REMAIN (45) | Days of fuel remaining equal to quantity remaining divided by average used over previous two days. Appears on 42. |
| Time (in 41) | Hours on 56, minutes on 50, seconds on 42. |
| Test (in 41) | Displays all 8's on 56, 50 and 42 and momentarily illuminates all indicator lights. |
| + $ (in 41) | Turns all displays and indicators off. |
| $/Day | Shows total cost of fuel used two days ago on 56, total cost of fuel used yesterday on 50. |

The following table describes the sequences which are used for entering data into the system manually so that various values, such as time and alarm limits, can be stored in the system memory for subsequent processing.

TABLE II

Date entering Sequences

| Function | Key Operation Sequence |
|---|---|
| Set Time<br>Example: 5:03:26 PM | ENTER, TIME, 1, 7, ENTER, 3, ENTER, 2, 6, ENTER |
| Set amount and cost of fuel put into storage (rounded)<br>Example: 99.7 gals, $115 | ENTER, + FUEL, + $, 1, 0, 0, ENTER, 1, 1, 5 ENTER |
| Set alarm limit for TS and set point for TN<br>Example: TN 1850° F.<br>TS 558° F. | ENTER, TEMP, 1, 8, 5, 0, ENTER, 5, 5, 8, ENTER |
| Set alarm limit for TE<br>Example: 650° F. | ENTER, TE, 6, 5, 0, ENTER |
| Set alarm limit for days of fuel remaining (min.)<br>Example: 5 days | ENTER, DAYS REMAIN, 5, ENTER |
| Set alarm limit for quantity of fuel remaining (min.)<br>Example: 36 gallons | ENTER, FUEL REMAIN, 3, 6, ENTER |
| Set current sensed values of TN, TS, TE, % EFF and Smoke capacity as alarm limit values or set points | ENTER, ENTER |
| Clear all fuel and dollar data from memory | CLEAR, + FUEL |
| Clear all alarm values and set points from memory | CLEAR, CLEAR |

Various values can be displayed, as needed, to be sure that the set points and limits previously inserted are correct, or to review those limits if it appears that changes are appropriate. The following table identifies the set points or limit values in this category and indicates the key sequence for obtaining displays of those values.

TABLE III

| Display of Limit Values of Set Points | |
|---|---|
| Set Point or Limit Value | Key Operation Sequence |
| % Efficiency set point | RECALL, % EFF (Display on 42) |
| Smoke capacity limit | RECALL, SMOKE (Display on 42) |
| Low fuel remaining, limit (in gallons or MCF) | RECALL, FUEL REMAIN (Display on 50) |
| Low fuel remaining, limit (in days) | RECALL, DAYS REMAIN (Display on 42) |
| Current limits for TN and TS and current value for % efficiency | RECALL TEMP (Display of TS on 42; TN on 50; % EFF on 56) |
| TE | RECALL, TE (Display on 42) |

In each of Tables II and III, the keys are simply operated in the sequence listed in order to insert the value or obtain the desired display.

As previously stated, it is much preferred that the system of the present invention use a microprocessor for purposes of gathering and storing from the transducers and from the keyboard inputs, performing the necessary calculations, producing displays and sounding alarms. The following figures illustrate the process steps for the microprocessor and its associated software routines.

Figure 4:
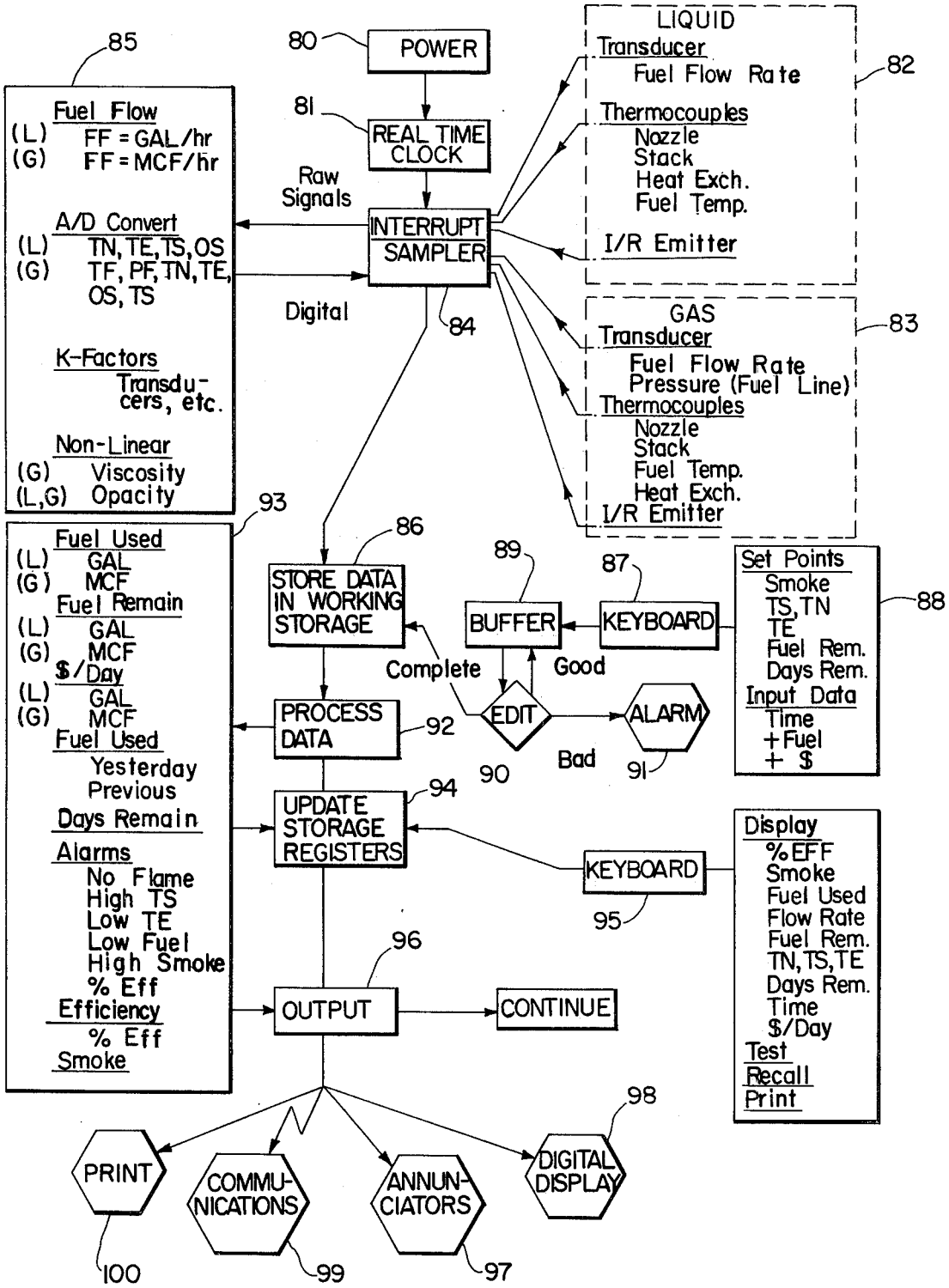
FIGS. 4–9 are flow diagrams illustrating process steps involved in the operation of the apparatus of FIGS. 1–3.

FIG. 4 is an overall flow diagram for the system showing the major functions. Power is supplied, as indicated in block 80, using line voltage which would normally be supplied to a regulated power supply which can include a rechargeable battery and a battery charger unit, in conventional fashion, so that the time and data bits previously stored will not be lost in the event of power failure. A real time clock 81 provides a time base for time display and for calculation of the various rate functions.

The various transducers used in conjunction with the system produces signals which are normally analog in form, with the exception of the fuel flow transducer, and which, in some cases, are non-linear or require scaling. Blocks 82 and 83 represent the various transducers which supply signals to the system by a sampling technique as indicated at block 84. It will be noted that there are some differences in signal development and handling depending upon whether the fuel used is primarily liquid (i.e., fuel oil, distillates and residuals) or is a gaseous form of fuel as delivered to the burner (i.e., gas, butane, propane or the like) even though the fuel might be stored in a liquefied form. It is a simple matter in a microprocessor to provide input and processing capability for dealing with both situations and then to "jump" out the functions not needed at the time of installation. Thus, both sets of transducers which would be used with a liquid fuel and block 83 showing those transducers which would be used with a gas fuel.

The raw signals from the transducers are subjected to preliminary processing, block 85, including the calculation of fuel flow in either gallons per hour or thousand cubic feet per hour, depending on whether the fuel is liquid or gas. In block 85, as well as some other areas, those steps which are particularly useful with one or the other of liquid fuels are indicated by (L) or (G). Depending upon the transducers selected, some factors will be scaled by multiplication by K-factors and certain functions which are non-linear can be linearized by conventional programs for that purpose, a specific example being viscosity and opacity. The various temperature and other measurements are then converted to digital form, in conventional fashion, and the digitized signals are returned through block 84 and delivered to storage 86 for future processing and recall.

Keyboard entries 87 of the various set points and input data listed in block 88 are supplied through buffer 89 and editing 90 to the working storage, the editing being for the purpose of assuring that the inputs are in an acceptable format. If not, an indication is given by alarm 91, as previously indicated. Data processing 92 involves interaction with the data stored and calculation and retention of the functions listed in block 93. The calculations are used to update the parameters stored in the working storage registers, 94, and the data is available for display upon operation of the keyboard as indicated at 95 and as described in the foregoing tables. Stored data points and calculated values entered at the keyboard are as indicated at 95 and as described in the foregoing tables. Stored data points and calculated values can be used as an output 96. It will be mentioned at this point that the present system is disclosed as having annunciators as 97 and digital 98, but two other optional functions can be added to the system without modification of the basic equipment, one being a communications option 99 which permits the information developed to be transmitted to a remote location, this option being of particular value when a system is employed in a small commercial establishment and is being monitored in conjunction with other similar systems at a central location. Additionally, the apparatus can be supplied with a printer or magnetic tape cassette 100 so that selected values can be printed or digitally stored for subsequent review. This is of particular value in a commercial installation wherein trends in efficiency, fuel used, smoke or other values are of great significance and reliance upon the memory of an operator, who may be observing numerous numerous systems, is not sufficient.

Figure 5:
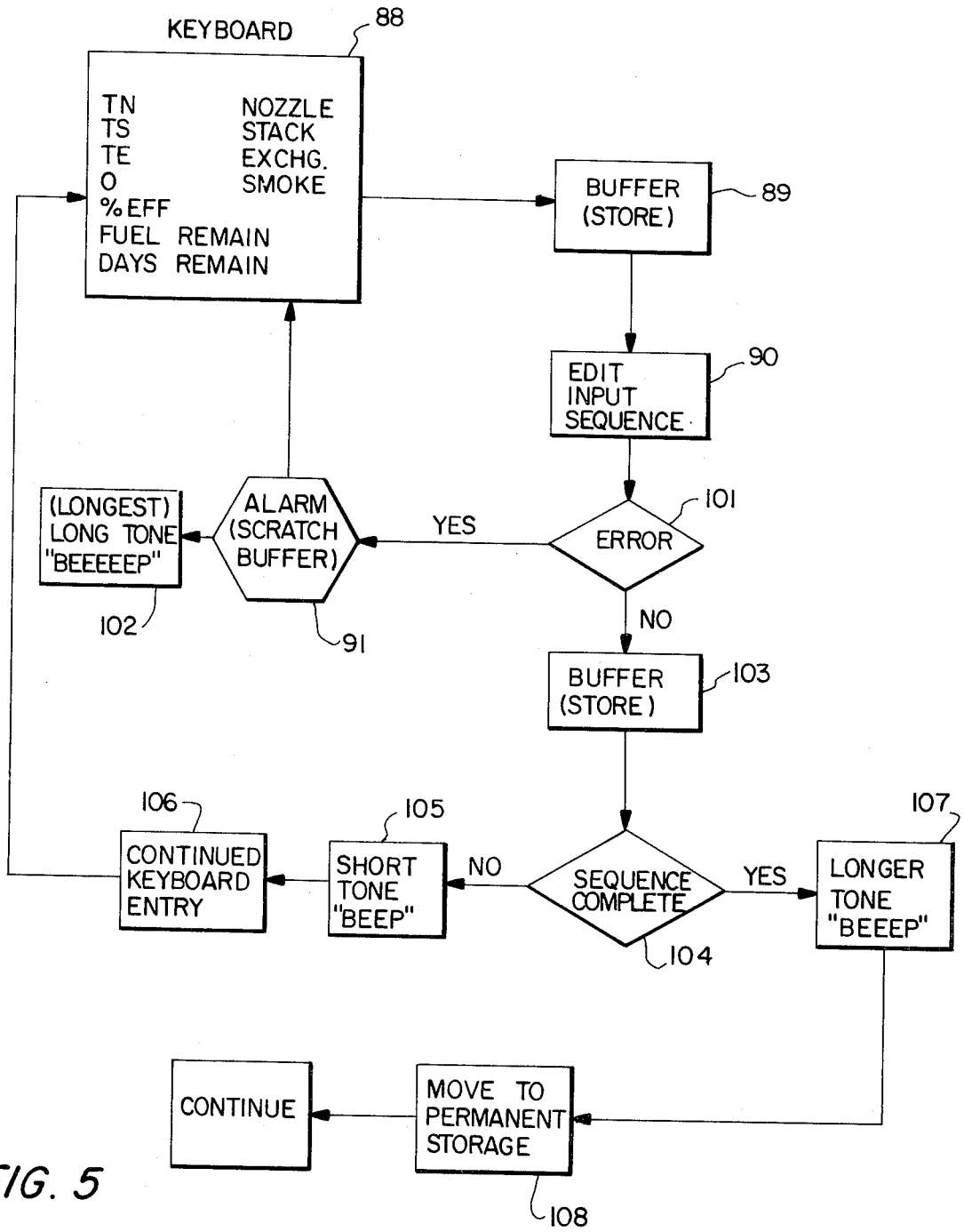

FIG. 5 shows in greater detail a sub routine for the entry of sub points or alarm levels which are inserted by operating the keyboard as shown at 88 through the buffer and editing sequence 89 and 90. The detection of an error 101 causes an alarm signal 91 to be generated, producing the longest of the four tone codes. 102. "No error" permits the input to be buffered 103 into storage, the sequence being evaluated for completeness 104. If the sequence is incomplete, the short tone 105 is generated, indicating that keyboard entries 106 should be continued. If the sequence is complete, the longer tone 107 indicates to the operator that the sequence is complete and the data is moved to permanent storage 108 and other functions can be performed.

Figure 6:
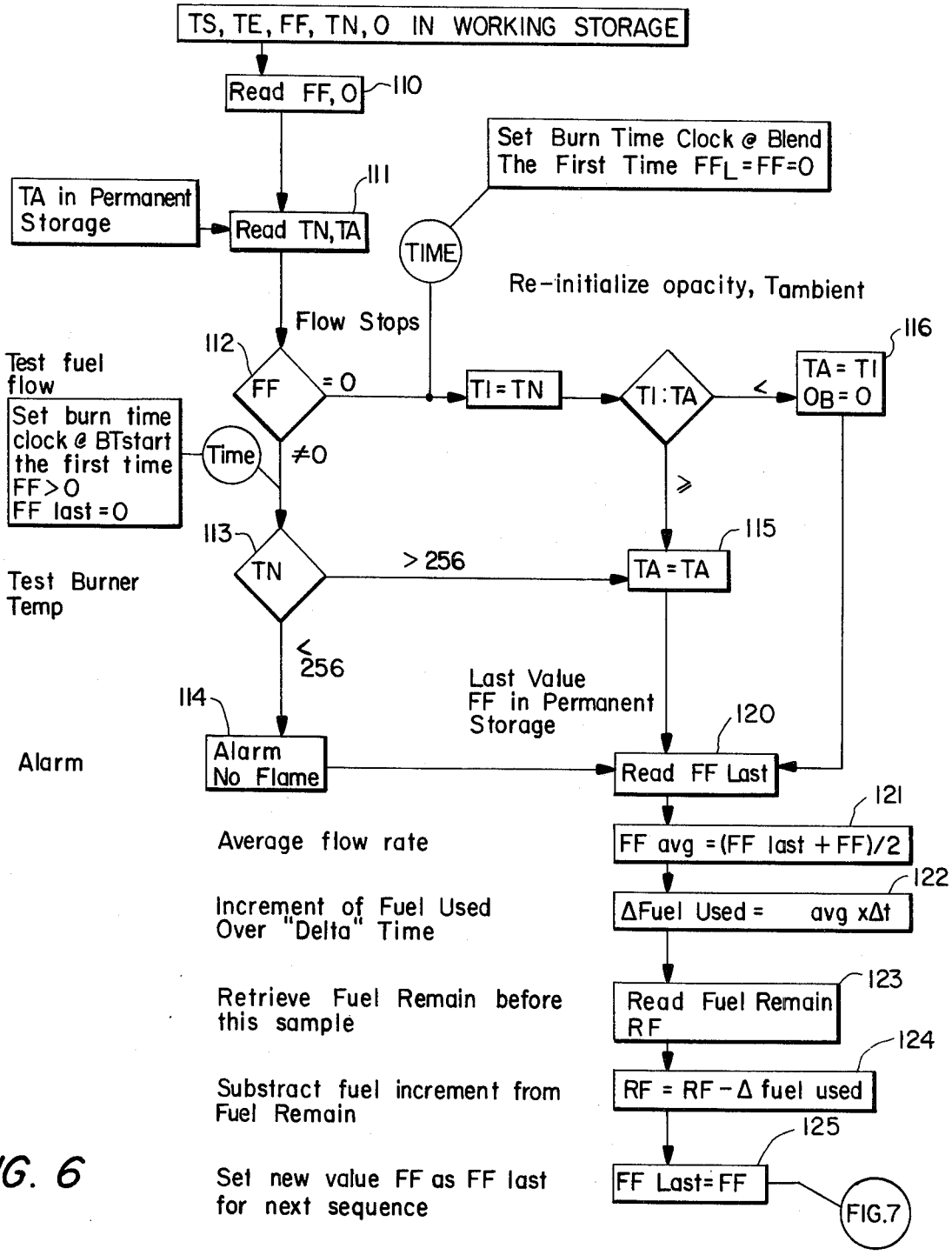
Figure 7:
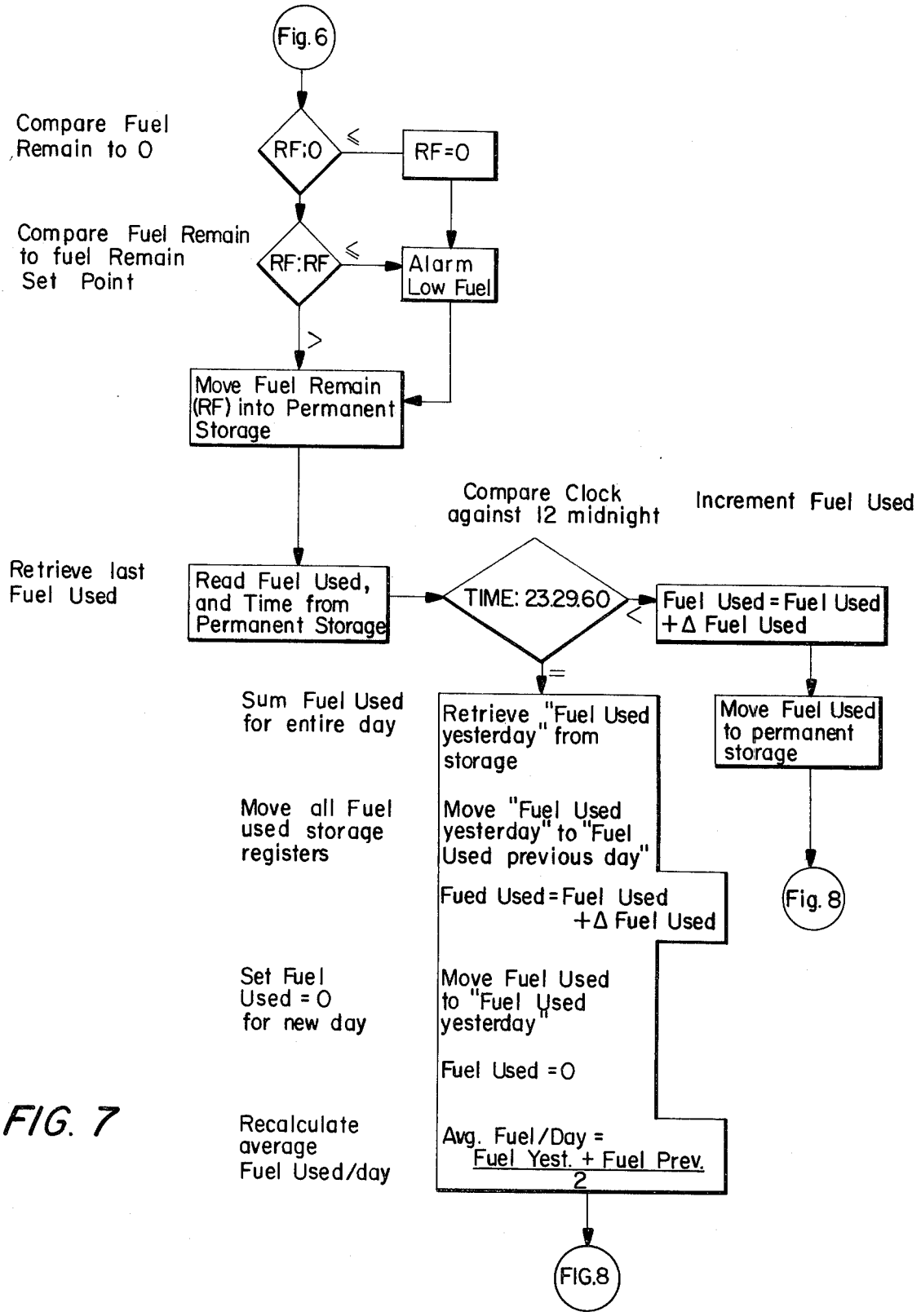
Figure 8:
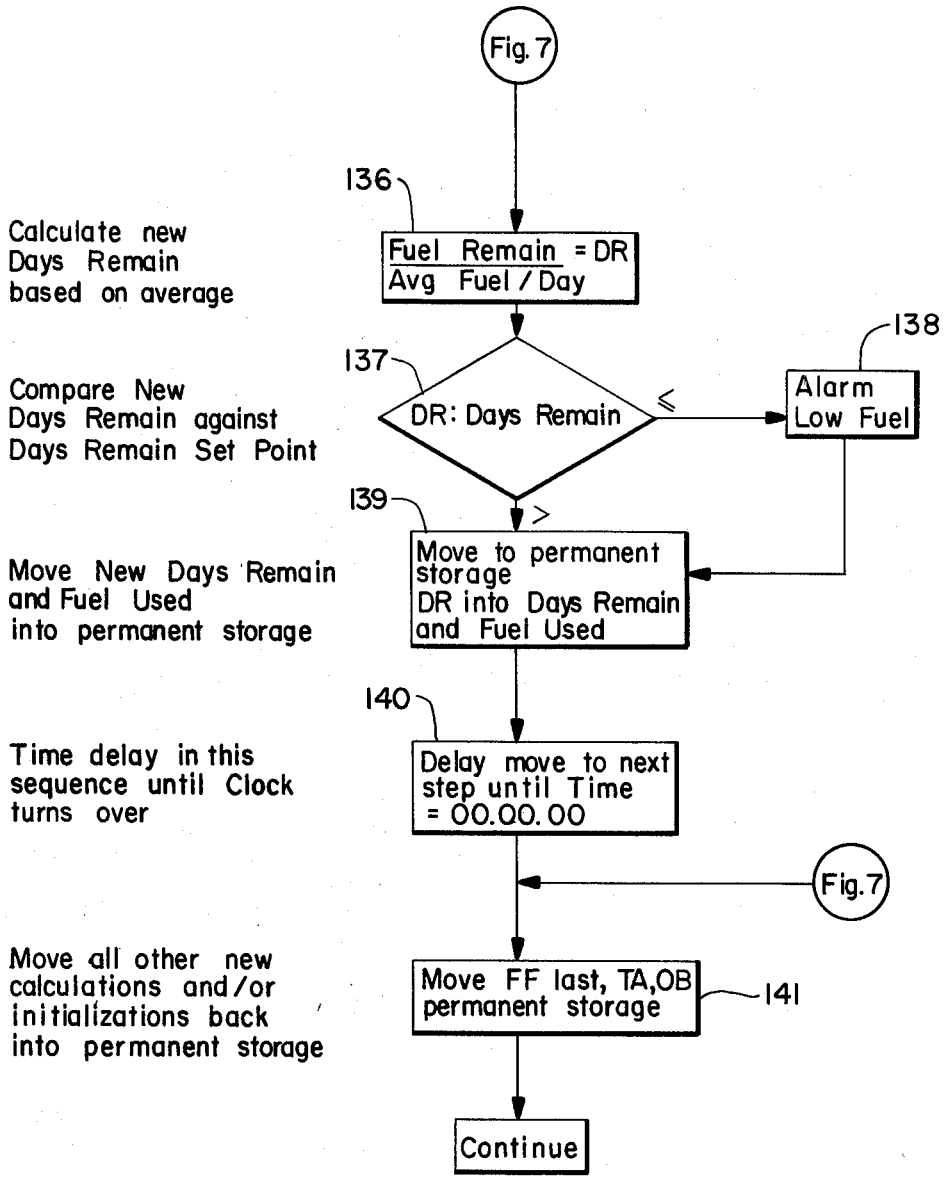

Calculations performed in the system are shown in FIGS. 6, 7 and 8. Referring first to FIG. 6, fuel flow, opacity and nozzle temperature are read out of working storage and a value of ambient temperature TA is read out of "permanent" storage, 110 and 111. The value of TA is used later in efficiency calculations, and its use here is as a reference for comparison of TN. As will be recognized, the starting and stopping of fuel flow is a measure of burn time which is a useful piece of information in some circumstances. The system is therefore provided with a burn time (BT) storage register and, if the system is provided with a printer, the burn time can be printed out as part of the normal sequence. Initially, TA is set at a convenient temperature, e.g., 72° F., and fuel flow is zero. With fuel flow not equal to zero as detected at branch 112, the burn time clock is started and nozzle temperature is checked at 113 to be sure that flame is present. A TN at or below 256° F. is interpreted as no flame and an alarm 114 is activated. With TN greater than 256°, FF is read at 120.

When fuel flow next reaches zero, the burn time clock indicates the end of the BT interval and the nozzle rapidly cools to a temperature Tl. The opacity value is reinitialized and the TA value is reinitialized at TS if, and only if, TS is less than TA, 115, 116.

The last fuel flow stored in 120 is then used to calculate the average fuel flow rate 121, and the quantity of fuel used during the most recent burn is calculated by multiplying the average fuel flow by the increment of time, which is equivalent to the burn time, 122. The previous fuel remaining quantity is than read 123 and the remaining fuel quantity is updated by substracting the increment of fuel used in the most recent burn from the previous remaining fuel (RF) reading. The new flow rate value is then set 125.

The sequence then continues on FIG. 7 in which the remaining fuel is compared with zero 125 and if the indication is that the fuel quantity is equal to zero 127 an alarm 128 is activated. If the fuel remaining is greater than zero, the fuel quantity remaining is compared with the fuel remaining set point 129. An indication that the fuel is equal to or lower than the set point quantity, the alarm 128 is activated, but if the fuel remaining quantity is greater than the set point the fuel remaining figure is moved into permanent storage 130. The fuel used and time are then read from permanent storage 131 and the time is compared with midnight 132 to determine whether it is appropriate to calculate and summarize for the usage during a day. If the indication is that the day is not yet complete, the fuel used is updated by adding the incremental fuel used 133 and the updated quantity is moved to permanent storage 134. If the clock comparison indicates that the day has been completed, the fuel used for the entire day is summed and the total used yesterday is moved to the fuel used previous day register and the fuel used during the day just calculated is moved to the fuel used yesterday register. The current days fuel used is then initialized to zero, 135. Finally, the average fuel usage per day is calculated by summing the fuel used yesterday and the previous day and dividing by 2. The branches from blocks 134 and 135 then continue on to FIG. 8 branch 14 being used to calculate the days of fuel remaining based on the average calculated by divided the fuel remaining by the average usage per day FIG. 136, and this is compared with the days remaining set point 137, giving an alarm 138 if the calculated days remaining is less than the set point, and moving the days remaining to storage if the remaining fuel is greater than the set point. Both days remaining and fuel used are then moved into permanent storage 139. The next step 140 is a delay until the clock turns over to the zero points for the next days operation at which time the various quantities calculated and as shown in FIG. 8 are moved into permanent storage for future reference 141.

Figure 9:
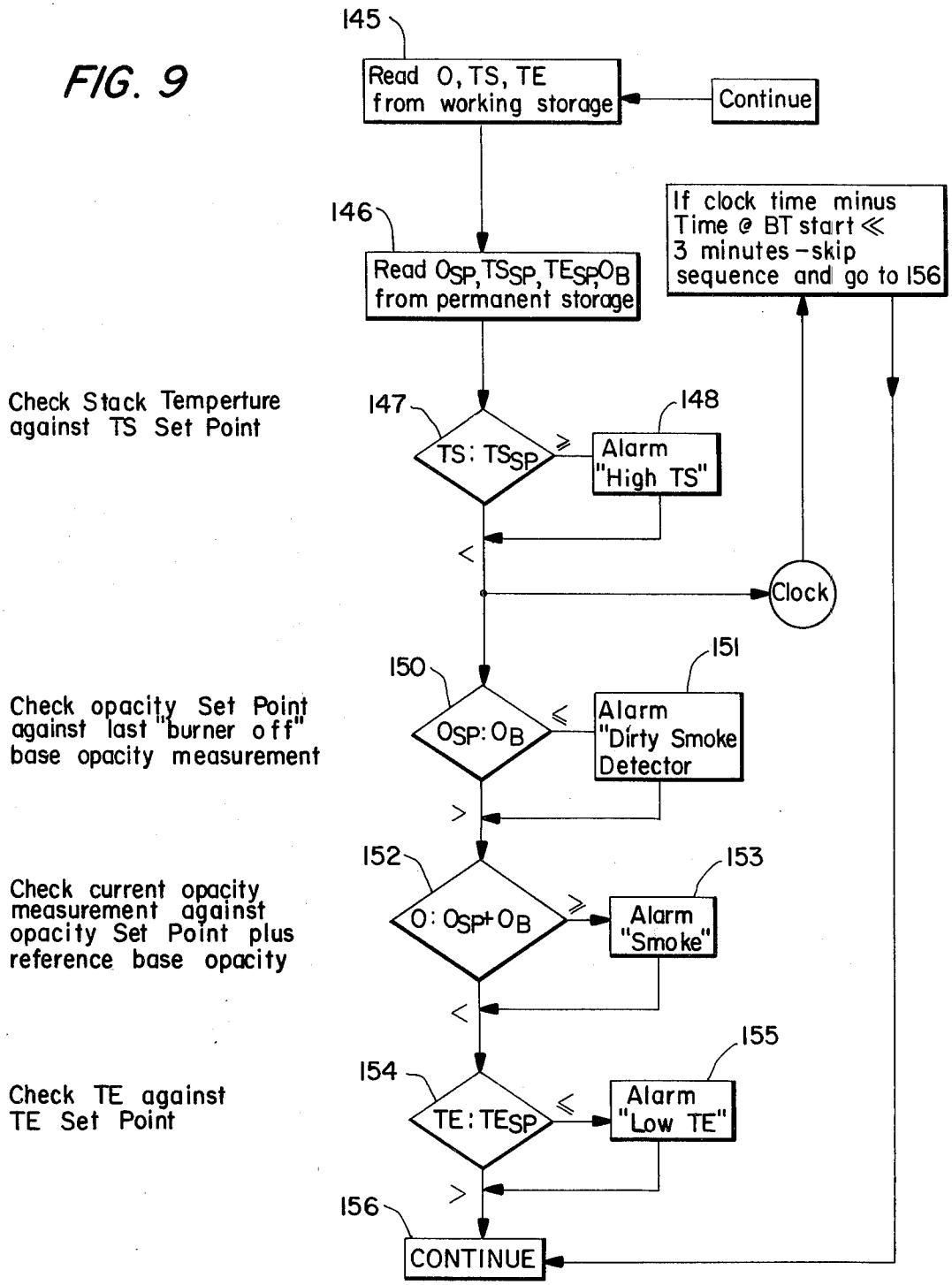

Turning now to FIG. 9, further calculations of parameters and comparisons therewith to the established set points are shown. The opacity, stack temperature and exchanger temperature are read out of working storage 145 and the set points for stack and exchanger temperatures and opacity and the base opacity figures are read out of permanent storage 146. The stack temperature is then compared with the stack temperature set point 147 and an alarm 148 is activated if the stack temperature exceeds the set point. If the stack temperature is below the set point the clock is checked to see if the clock time is less than 3 minutes after the burn time start. If it is, the subsequent sequences shown in FIG. 9 are skipped because there has not been sufficient time to develop a meaningful opacity or exchanger temperature readings, as indicated at 149. If the sequence is accomplished after the 3 minute delay, the next step is comparison of the opacity set point with the last burner off base opacity measurement 150 and if the base exceeds the set point a "dirty smoke" alarm 151 is activated. If not, current opacity measurement is compared with the sub point plus the base 152 and the alarm is again given if the reading exceds the sum 153. The next step is comparison of the exchange of temperature with the exchanger set point 154 resulting in an alarm 155 if the exchanger temperature is below the established set point.

Figure 10A:
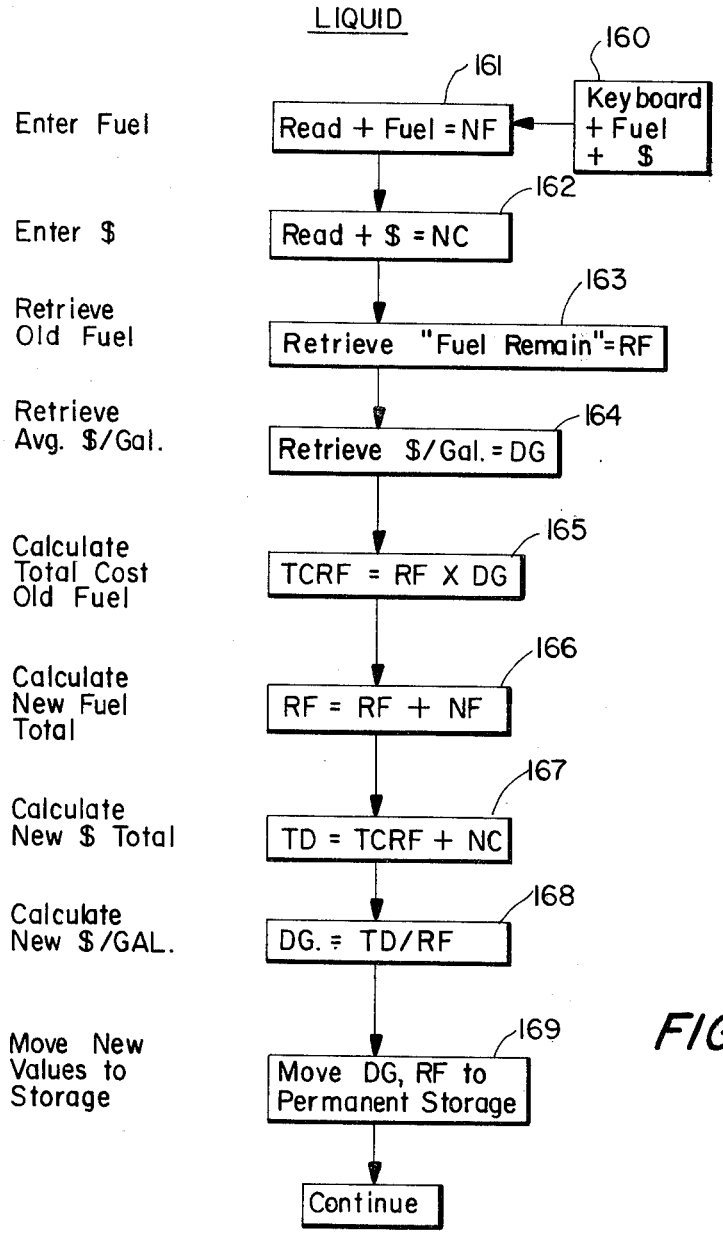
Figure 10B:
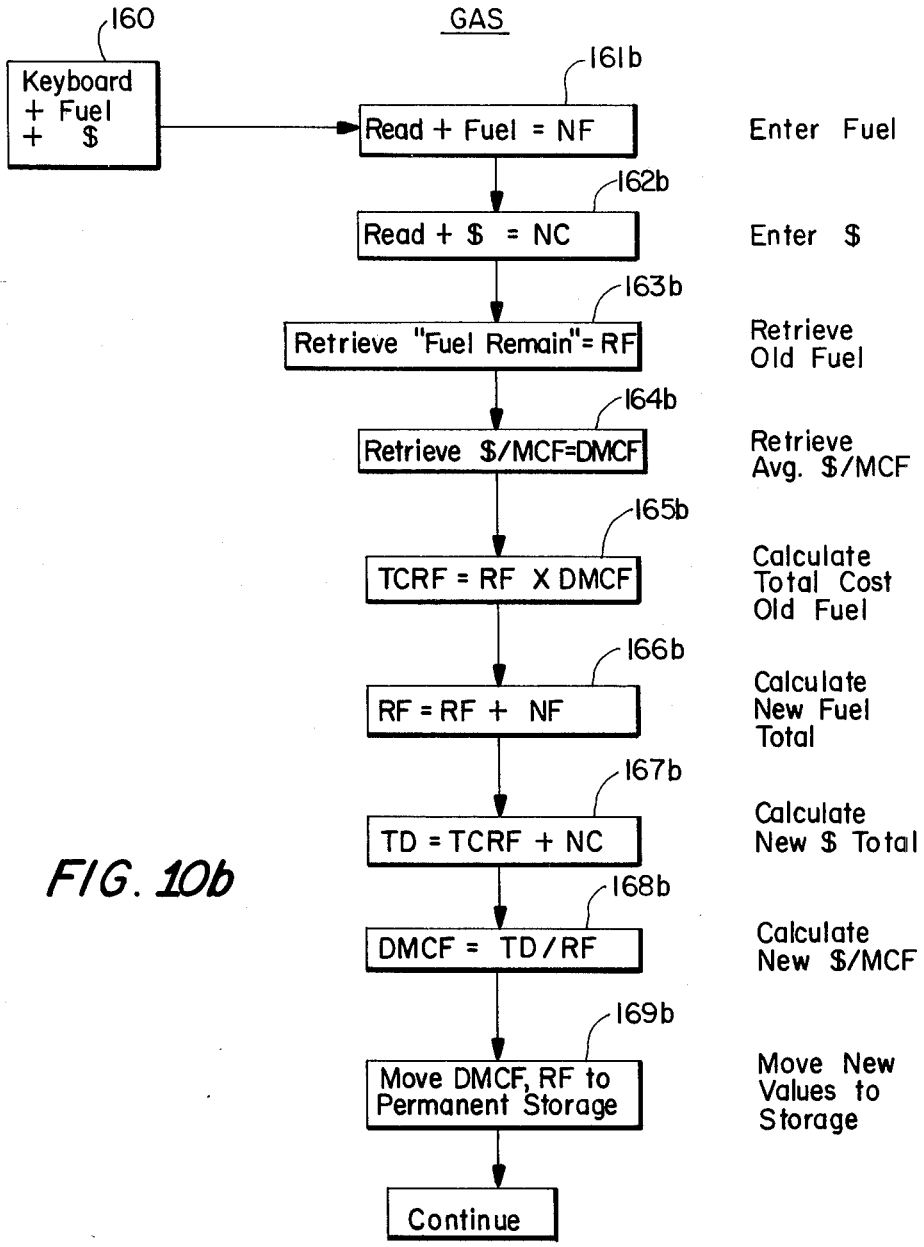

FIGS. 10*a* and 10*b* illustrate data processing using standard calculations with the keyboard, FIG. 10*a* being the sequence for use with a liquid fuel and FIG. 10*b* being the sequence with the gas fuel. Referring now to FIG. 10*a*, it will be recognized that this sequence involves the second data entering sequence set forth in Table II. The "+fuel" and "+$" keys are actuated to enter the quantity and cost of fuel added to storage, 160, 161 and 162. The program then retrieves the previous quantity fuel remaining 163 and the average cost 164, calculates the total cost of the old fuel 165, calculates the new fuel total 166, calculates the new cost total 167 and a new cost per gallon 168. The new quantity and cost figure are then moved to permanent storage.

An analoguous sequence will be seen in FIG. 10*b* in which the same reference numerals are used with the addition of the letter "b", the only difference being the units of measure. In this connection, it will be noted that whether the system employs metric or other measure is of little consequence since the difference is accomplished by only a change in the scale factors.

The percentage of thermal efficiency is calculated in the system using the relationship $$\%E=(TN-TS)/(TN-TA).$$

While certain advantageous embodiments have been chosen to illustrate the invention it will be understood by those skilled in the art that various changes and modifications can be made therein without departing from the scope of the invention as defined in the appended claims.

What is claimed is:

1. A monitoring and display apparatus for use in combination with a heating system of the type having a combustion chamber, adjustable means for supplying air to said combustion chamber to support combustion, an exhaust duct for exhausting combustion products from the combustion chamber, a fuel input nozzle and conduit means connectable to a fuel source for supplying fuel to the combustion chamber, and a heat exchanger in the gas flow path between the combustion chamber and the exhaust duct for heating a fluid medium, the apparatus comprising first and second transducer means for sensing the tempertures at the combustion chamber and the exhaust duct, respectively, and for producing electrical signals representative of said temperature;

third transducer means coupled to said conduit means for sensing the rate of flow of fuel to said fuel input nozzle and;

logic display means electrically connected to said transducer means for calculating and selectively displaying parameters representative of the operation of said heating system comprising a clock;

memory means for storing digital data representative of the temperature and flow rate parameters sensed by said transducers and of preselected limit values for selected ones of said parameters;

input means including a keyboard for manually supplying said preselected limit values to said memory means;

calculator means responsive to said clock and to the sensed parameters stored in said memory means for calculating fuel usage per unit time and for supplying signal representative thereof to said memory means; and alarm means for periodically comparing said limit values with the sensed parameters and for providing a perceivaable indication when said limit values are exceeded.

2. An apparatus according to claim 1 and further comprising fourth transducer means coupled to the exhaust duct fo producing a signal representative of the level of unoxidized carbon in the combustion products flowing through said duct.

3. An apparatus according to claim 2 and further comprising fifth transducer means for sensing the temperature at the heat exchanger and for producing electrical signals representative of said temperature.

4. An apparatus according to claim 3 wherein said heating system includes a fuel storage container having a finite capacity, and said apparatus further includes means for supplying to said memory means a signal representative of the quantity of fuel supplied to said container;

means in said calculator means responsive to said singals representative of quantity of fuel and of fuel usage per unit time for producing signals representative of fuel remaining;

and wherein said input means includes means for supplying a preselected minimum fuel quantity remaining as one of said limit values.

5. An apparatus according to claim 4 wherein said fuel quantity remaining is calculated both as an absolute quantity remaining and as days remaining at the average use rate.

6. An apparatus according to claim 3 wherein said input means includes means for inserting a limit value for heat exchanger minimum temperature.

7. An apparatus according to claim 3 wherein said first, second and third transducers comprise thermocouples.

8. An apparatus according to claim 1 wherein the fuel source is a source of combustible gas.

* * * * *